United States Patent [19]

Boilen

[11] Patent Number: 5,005,161

[45] Date of Patent: Apr. 2, 1991

[54] CHANGEABLE WATCH BEZEL LOCKING MECHANISM

[75] Inventor: Irving Boilen, New York, N.Y.

[73] Assignee: Trans-Action Marketing Corp., New York, N.Y.

[21] Appl. No.: 510,314

[22] Filed: Apr. 17, 1990

[51] Int. Cl.[5] ..... G04B 37/00

[52] U.S. Cl. ..... 368/295

[58] Field of Search ..... 368/294–296, 368/88, 276, 284, 309

[56] References Cited

U.S. PATENT DOCUMENTS

| | | | |
|---|---|---|---|
| 3,386,239 | 6/1968 | Shiffman | 368/296 |
| 4,447,162 | 5/1984 | Mitamura et al. | 368/295 |
| 4,742,503 | 5/1988 | Braun et al. | 368/282 |
| 4,815,053 | 3/1989 | Dal Busco | 368/294 |

*Primary Examiner*—Vit W. Miska

*Attorney, Agent, or Firm*—Blum Kaplan

[57] ABSTRACT

A timepiece having a bezel that is adapted to be removeably secured to a wristwatch body is provided. A first locking mechanism and a second locking mechanism are associated with a wristwatch body and bezel, respectively. The second locking mechanism associated with the bezel is secured to the first locking mechanism associated with the wristwatch body by inserting the bezel over the wristwatch body and rotating the bezel into a locked position. The bezel is removable from the wristwatch body by rotating the bezel in the opposite direction so that the bezel can be removed from the wristwatch body.

8 Claims, 2 Drawing Sheets

FIG. 1
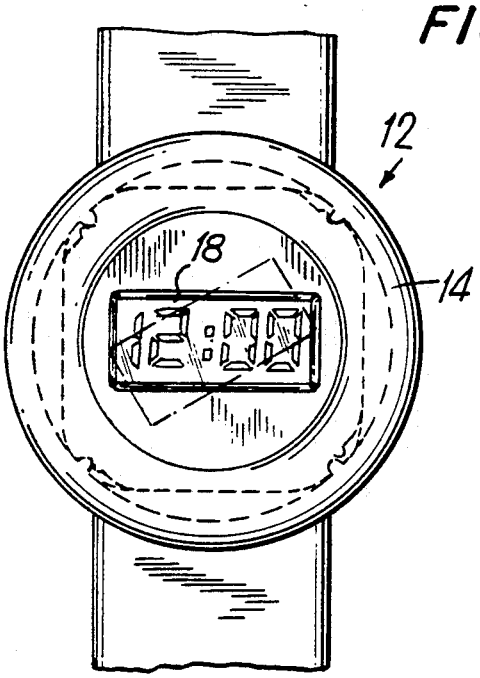
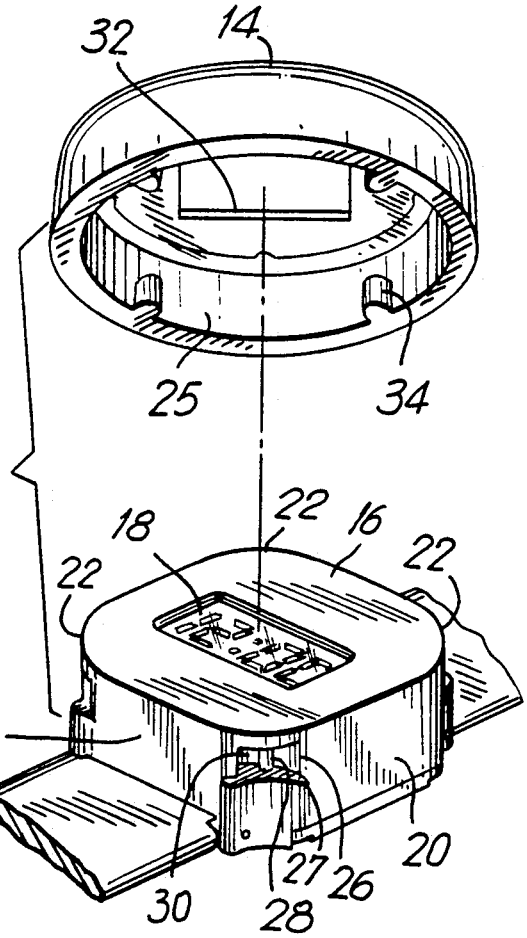
FIG. 2
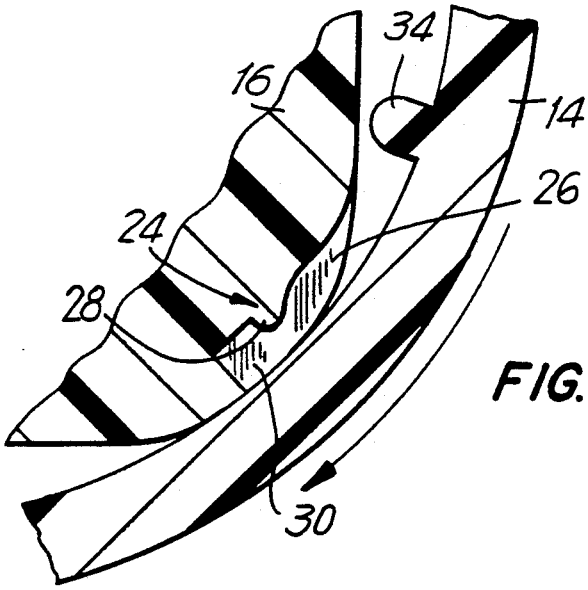
FIG. 3

CHANGEABLE WATCH BEZEL LOCKING MECHANISM

BACKGROUND OF THE INVENTION

This invention is directed to a child's watch and, in particular, to a child's watch that has a changeable watch bezel which is securely attached to a timepiece by a unique locking mechanism.

Over the years, children's watches have been used for a variety of purposes. One such purpose is an amusement device for capturing the imagination of a child. However, the novelty of a standard watch as a toy will wear off quickly due to the short attention span of a child.

Manufacturers have developed several modifications of a child's watch that provide amusement value to a child. One such watch provides a bezel which can be changed depending on the outfit or the mood of the child. However, a disadvantage of such watches is that the bezel easily falls off and is subsequently lost. Accordingly, an improved child's watch wherein bezels of different colors and designs can be easily changed and yet securely affixed to the watch is desired.

SUMMARY OF THE INVENTION

Generally speaking, in accordance with the present invention, a child's watch with a changeable watch bezel locking mechanism is provided. The watch assembly includes a timepiece having a time display, a bezel and locking mechanism. The locking mechanism includes a first locking mechanism associated with the watch and a second locking mechanism associated with the bezel. The second locking mechanism cooperatively associates with the first locking mechanism so that the bezel can be releaseably secured to the timepiece. The bezel is releaseably secured to the timepiece by placing it over the timepiece and twisting the bezel through an angular rotation of less than 90° so that the first locking mechanism couples to the second locking mechanism thereby mounting the bezel to the watch. The bezel is removable by rotating the bezel in the opposite direction to the direction that caused the bezel to be secured to the watch so that the bezel can be easily disengaged from the watch.

Accordingly, it is an object of the invention to provide an improved child's watch.

A further object of the invention is to provide an improved locking mechanism for attaching a bezel to the timepiece.

A further object of the invention is to provide a watch in which the locking mechanism securely attaches the bezel to the timepiece.

Yet a further object of the invention is to provide a locking mechanism which releaseably but securely affixes a bezel to a timepiece.

Still other objects and advantages of the invention will in part be obvious and will in part be apparent from the specification.

The invention accordingly comprises the features of the construction, combination of elements and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 1 is a plan view of the watch assembly in accordance with the invention;

FIG. 2 is an exploded perspective view of the watch assembly depicted in FIG. 1;

FIGS. 3–5 are enlarged partial sectional views illustrating the manner in which the bezel is secured to a watch body in accordance with the instant invention.

DETAILED DESCRIPTION OF THE PREFERRED EMBODIMENTS

Figure 4:
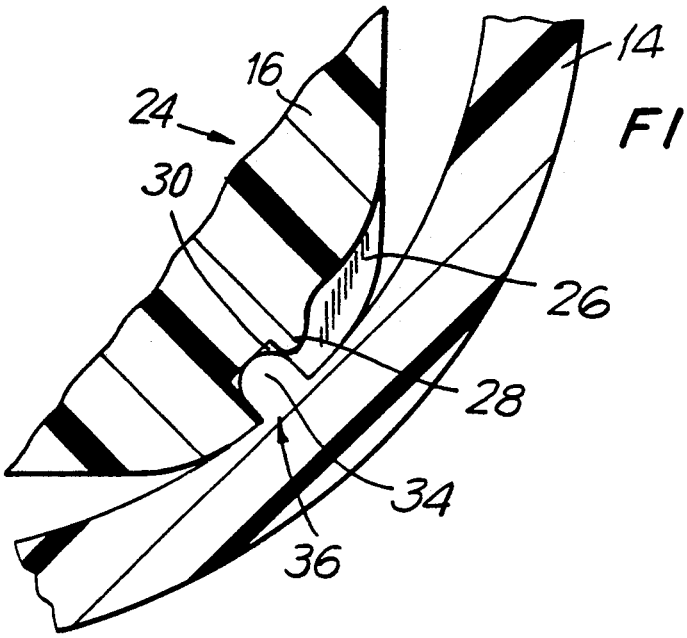

FIGS. 1 and 2 illustrate a watch assembly, generally indicated at 12, including a bezel 14 and a wristwatch body 16. Wristwatch body 16 includes a conventional digital time display 18 of the type normally found in electronic timepiece and is formed of a molded plastic. Bezel 14 is also formed of a molded plastic and as explained in detail below can be made in numerous colors.

The shape of wristwatch body 16 is defined by a cylinder having four chord shaped sections that define flat walls 20 of equal length separated by curved corners 22. A first locking recess 24 is formed within each of the curved corners 22. First locking recess 24 includes a flared entrance region 26, an indented region 30 and a locking bar 28 projecting out from indented region 30. A projection 27 is formed beneath indented region 30 on curved corner 22 and is provided to prevent the face of the watch body 16 from making contact with the interior of bezel 14.

Bezel 14 is circular in shape and contains an opening 32 therein defining a display region. Bezel 14 includes a depending wall 25 around entire circumference thereof. A plurality of projections 34 are disposed on the inside wall 25 and define a second locking mechanism for use in combination with the first locking mechanism.

Figure 5:
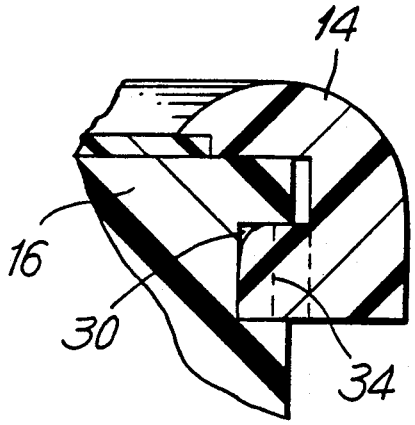

Referring to FIGS. 3 through 5, the interrelationship between the bezel 14, the wristwatch body 16 and the locking mechanism is depicted in detail. Specifically, when bezel 14 is to be placed upon wristwatch body 16, the projections 34 and the opening 32 in the bezel must be oriented at an angle with respect to the timepiece display in the wristwatch body. Unless the opening is disposed at an angle with respect to the wristwatch body display, the projections will not permit the bezel to be placed over the wristwatch body since the projections will not clear the curved corners 22 which are disposed to have an outer diameter that is slightly smaller than the inside diameter of the side wall of the bezel. After the bezel is placed over the wristwatch body, the bezel is rotated in a clockwise direction so that the projections 34 are brought into the entrance region 26 of indented region 30. By continuing to rotate the bezel in a clockwise direction, projections 34 slide into entrance region 26, over locking bar 28 and come to rest in locking region 30. In this manner, the bezel is releaseably secured to the wristwatch body.

Reference is specifically made to FIG. 5 wherein the manner in which projection 34 is secured tightly within locking region 30 is depicted. When it is desired to remove bezel 16 from wristwatch body 14, bezel 16 is rotated or twisted in a counterclockwise direction so that projections 34 continue to be rotated over locking bar 28 and out of indented recess 30 thereby permitting the bezel to be easily removed from the watch body.

Accordingly, by providing bezels having different colors, designs, etc., a child can easily replace the bezel on the wristwatch body without being concerned that the bezel will accidentally fall away from or be removed from the wristwatch body. Nevertheless, when it is intended to change the bezel, such changing can be effected easily thereby providing a wristwatch having an entirely new appearance and an enhanced play value.

Figure 6:
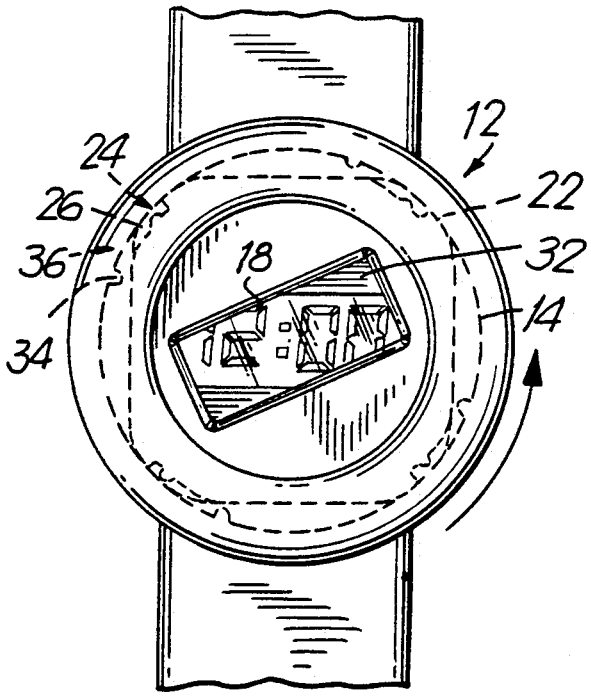
FIG. 6 is a plan view illustrating the manner in which the bezel is removed from wristwatch body.

Referring specifically to FIG. 6, when it is desired to remove bezel 16 from wristwatch body 14, bezel 16 is twisted at an angle less that 90° wherein projections 34 continue to be rotated over locking bars 28 and out of recess 30 thereby permitting the bezel to be easily removed from the wristwatch body.

This locking mechanism provides a method for safe and easy locking and unlocking of a bezel onto a wristwatch body. Moreover, once bezel 14 is locked into its position it cannot be removed without twisting it in the opposite direction of the locking method.

It will thus be seen that the object set forth above, among those made apparent from the preceding description, are efficiently attained and, since certain changes may be made in carrying out the above process, in the described product and in the construction set forth without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A watch assembly comprising in combination a wristwatch body including a time display, the cross-section of the wristwatch body being cylindrical and defining a circular cross-section with a plurality of chord sections, said wristwatch body including a first locking means, and a bezel adapted to be positioned on said wristwatch body, said bezel including a second locking means, said second locking means including at least one radially disposed projection being cooperatively associated with said first locking means on said wristwatch body so that said bezel can be releasably secured to said wristwatch body by placing said bezel over said wristwatch body and by rotating said bezel into a locked position, whereby each chord section is separated by a curved region, each said chord section providing clearance for said radially disposed projection so that said wristwatch body integrally fits into said bezel, said bezel being removable from said timepiece by rotating said bezel in the opposite direction.

2. The watch assembly of claim 1, wherein said wristwatch body includes a time display region.

3. The watch assembly of claim 1, wherein said curved region is comprised of a first locking means, said curved region including a grooved recess having a raised locking bar within said recess.

4. The watch assembly of claim 1, wherein said bezel is circular.

5. The watch assembly of claim 1, wherein said bezel includes a display region in its center for orientation with said time display region of said timepiece.

6. The watch assembly of claim 3, wherein said second locking means includes a plurality of projections cooperatively associated with said first locking means.

7. The watch assembly of claim 6, wherein said projections are sized to integrally fit into said grooved recess of said first locking means.

8. The watch assembly of claim 3, wherein said second locking means releaseably secures said bezel to said wristwatch body by placing said bezel upon said body and rotating said bezel such that each projection of said bezels slides into the grooved recess of said curved regions of said wristwatch body so that said projections slide over said raised locking bar and into said grooved recess so that each projections is locked into said grooved recess.

* * * * *